US008695549B2

(12) United States Patent
Richter

(10) Patent No.: US 8,695,549 B2
(45) Date of Patent: Apr. 15, 2014

(54) VALVE TRAIN FOR INTERNAL COMBUSTION ENGINES FOR ACTUATING GAS EXCHANGE VALVES

(75) Inventor: Uwe Richter, Chemnitz (DE)

(73) Assignee: Iav GmbH Ingenieurgesellschaft Auto und Verkehr, Berlin (DE)

( * ) Notice: Subject to any disclaimer, the term of this patent is extended or adjusted under 35 U.S.C. 154(b) by 121 days.

(21) Appl. No.: 13/470,457

(22) Filed: May 14, 2012

(65) Prior Publication Data

US 2012/0285408 A1 Nov. 15, 2012

(30) Foreign Application Priority Data

May 13, 2011 (DE) ..... 10 2011 101 400

(51) Int. Cl.
*F01L 1/34* (2006.01)

(52) U.S. Cl.
USPC ..... 123/90.17; 123/90.15

(58) Field of Classification Search
CPC ..... F01L 13/0036; F01L 2013/0052
USPC ..... 123/90.15, 90.17, 90.31
See application file for complete search history.

(56) References Cited

U.S. PATENT DOCUMENTS

| | | | | |
|---|---|---|---|---|
| 5,129,407 | A | 7/1992 | Phillips | |
| 2010/0224154 | A1* | 9/2010 | Elendt et al. | 123/90.17 |
| 2010/0242884 | A1 | 9/2010 | Meintschel et al. | |
| 2010/0251982 | A1 | 10/2010 | Elendt et al. | |
| 2012/0006292 | A1 | 1/2012 | Elendt et al. | |

FOREIGN PATENT DOCUMENTS

| | | | |
|---|---|---|---|
| DE | 102004022832 | A1 | 12/2005 |
| DE | 102004022833 | A1 | 12/2005 |
| DE | 102007022145 | A1 | 1/2008 |
| DE | 102007016209 | A1 | 10/2008 |
| DE | 102007061353 | A1 | 6/2009 |
| DE | 102010013216 | A1 | 10/2010 |
| DE | 102009030373 | A1 | 12/2010 |
| EP | 0798451 | A1 | 10/1997 |
| WO | WO 2008012306 | A1 | 1/2008 |
| WO | 2009049801 | A1 | 4/2009 |
| WO | 2009083060 | A1 | 7/2009 |

* cited by examiner

*Primary Examiner* — Zelalem Eshete
(74) *Attorney, Agent, or Firm* — Leydig, Voit & Mayer, Ltd.

(57) ABSTRACT

A valve train device for switching lift of gas exchange valves of an internal combustion engine includes a camshaft including a carrier shaft and a cam assembly disposed non-rotatably and axially displaceably on the carrier shaft via a guide. The cam assembly includes a bearing region, at least one cam group having at least two cams and a first and a second axial contour. A bearing bush is mounted non-rotatably and axially displaceably in a camshaft bearing and radially supports the camshaft in the camshaft bearing. The cam assembly is mounted rotatably and axially displaceably in the bearing bush in the bearing region. The bearing bush includes a first axial reverse opposing contour that corresponds to, and is switchable into operative contact with, the first axial contour and a second axial reverse opposing contour that corresponds to, and is switchable into operative contact with, the second axial contour.

9 Claims, 2 Drawing Sheets

VALVE TRAIN FOR INTERNAL COMBUSTION ENGINES FOR ACTUATING GAS EXCHANGE VALVES

CROSS-REFERENCE TO PRIOR APPLICATION

Priority is claimed to German Patent Application No. DE 10 2011 101 400.8, filed on May 13, 2011, the entire disclosure of which is hereby incorporated by reference herein.

FIELD

The present invention relates to a valve train device for switching the lift of gas exchange valves of an internal combustion engine. To actuate the gas exchange valves, a camshaft is provided, on which a group of axially adjacent cams having different cam contours and/or different cam protrusions is arranged. It is possible to switch between the different cams by means of an actuation apparatus, whereby a respective cam of the cam group engages with the gas exchange valve and produces a lift corresponding to the cam contour.

BACKGROUND

A valve train for gas exchange valves of an internal combustion engine, comprising a displaceable cam carrier with an endless groove extending over the periphery is disclosed in German Application No. DE 10 2007 061 353 A1. The cam carrier is non-rotatably, yet axially displaceably mounted on a camshaft and has a plurality of axially spaced cams having different cam protrusions, which are combined to form a cam group for the respective gas exchange valve. An engagement element engages continuously in the endless groove and implements a lift in the axial direction according to the course of the endless groove. The engagement element can be locked in specific positions, forcing the cam carrier to perform an axial movement and thus switch between the cams for driving a gas exchange valve.

However, the described system is very bulky, and therefore use is only possible in internal combustion engines having sufficient cylinder spacing. Furthermore, an actuator for locking the engagement element is required for each displaceable cam carrier and has to be activated at the correct moment in time.

German Application No. DE 10 2009 030 373 A1 describes a valve train for an internal combustion engine having variable-lift gas exchange valve actuation. The camshaft of the valve train comprises a carrier shaft and a cam assembly mounted non-rotatably, yet axially displaceably thereon. The cam assembly contains cam groups of directly adjacent cams having different protrusions. A link is provided at the end of the cam assembly to displace the cam assembly axially with respect to the carrier shaft by engagement of an actuation element. The cam assembly rotating with the carrier shaft is mounted in a camshaft bearing.

The adjustment link on the cam assembly is arranged outside the camshaft bearing, whereby further axial overall space is provided for each cam assembly. A separate actuation element is required for each adjustment direction. Two actuators are therefore used for each cylinder of the internal combustion engine. The complex controls and expensive components required, in conjunction with the spatial requirement constitutes a fundamental drawback.

A valve train having variable-lift gas exchange valve actuation is disclosed in German Application No. DE 10 2010 013 216 A1. The valve train consists of a camshaft, which is formed of a carrier shaft and cam assemblies mounted non-rotatably, yet axially displaceably thereon. A cam group of directly adjacent cams having different protrusions and an axial link are located on the cam assembly. The cam assembly is also provided with a journal and is mounted via said journal in a camshaft bearing. The journal and the adjacent axial link are overlapped by the camshaft bearing, and therefore the actuation element for displacing the cam assembly is positioned on the camshaft bearing and extends radially through the bearing point to engage in the axial link.

Since the axial link and, also, the journal are overlapped by the camshaft bearing, the bearing point has to be particularly wide so as to provide the necessary bearing area according to the bearing stresses. This leads to an increased requirement of overall space. The system can only be used in internal combustion engines having sufficiently large valve spacing or cylinder spacing. In addition, an actuation element for each cam assembly is also required in this system. This conflicts with the current development aim of relatively compact internal combustion engines.

A switchable valve train of an internal combustion engine is described in German Application No. DE 10 2007 022 145 A1. The camshaft of the valve train comprises a driveshaft having at least one cam assembly which is arranged non-rotatably, yet axially displaceably thereon and which has a group of axially adjacent cams. The cams have different cam protrusions. The cam assembly is supported radially in a camshaft bearing point, jointly with the driveshaft and with an additional bearing bush mounted co-axially on the cam assembly. The additional bearing bush is axially displaceable relative to the camshaft bearing point and the driveshaft, jointly with the cam assembly, wherein the bearing bush is secured against rotation in the camshaft bearing point. The cam assembly and the bearing bush are thus accordingly arranged co-axially one above the other on the driveshaft and are mounted in the camshaft bearing point. In the bearing bush, a dowel is positioned parallel to the axis of rotation of the driveshaft and performs an oscillating movement as a result of a guide formed in the peripheral cam assembly with axial lift. To initiate a switching operation, the dowel is temporarily fixed axially at the corresponding point by a fixing apparatus. The cam assembly is thus supported on the fixed dowel. An axial movement of the cam assembly is forced and a switching operation is initiated.

The complex controls and the associated expensive component constitute a drawback of this device for switching the lift. A separate fixing apparatus, which has to initiate a switching operation at the correct moment in time, must be provided for each switching device of a cam assembly. The dowel also leads to high stresses in the guide groove during the switching operation. Furthermore, the dowel is subject to a high level of wear since it has to be clamped for each switching operation.

U.S. Pat. No. 5,129,407 describes an adjustment device for a camshaft, with which the camshaft can be displaced axially. Different cams having different cam protrusions can be positioned for the actuation of the gas exchange valves by the displacement of the camshaft. To displace the camshaft, an axial link is provided, with which axial displacement in both directions is enabled. To this end, the link has two contours extending over the periphery in a mirror-symmetrical manner, wherein each of the two contours produces the lift necessary for shifting to shift the camshaft. A region in which the permanently engaged adjustment dowel can be positioned without making contact with one of the two peripheral contours is provided between the two contours. To initiate a switching operation, the adjustment dowel is displaced in the axial direction and fixed so as to come into contact with one of the two contours and initiate the axial shifting of the camshaft in the corresponding direction.

However, the camshafts and cams positioned thereon of modern internal combustion engines having a plurality of cylinders do not allow simultaneous adjustment of the cams and therefore also do not allow displacement of the entire camshaft, since there is no crossover of the cam base circles between the different cylinders. In addition, the link necessitates an increase in the overall length of the camshaft.

SUMMARY

In an embodiment, the present invention provides a valve train device for switching lift of gas exchange valves of an internal combustion engine. The device includes at least one camshaft including a carrier shaft and at least one cam assembly disposed non-rotatably and axially displaceably on the carrier shaft via a guide. The at least one cam assembly includes a bearing region, at least one cam group having at least two cams and a first and a second axial contour, A bearing bush is mounted non-rotatably and axially displaceably in a camshaft bearing and radially supports the at least one camshaft in the camshaft bearing. The at least one cam assembly is mounted rotatably and axially displaceably in the bearing bush in the bearing region. The bearing bush includes a first axial reverse opposing contour that corresponds to, and is switchable into operative contact with, the first axial contour and a second axial reverse opposing contour that corresponds to, and is switchable into operative contact with, the second axial contour.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following.

DETAILED DESCRIPTION

Figure 1:
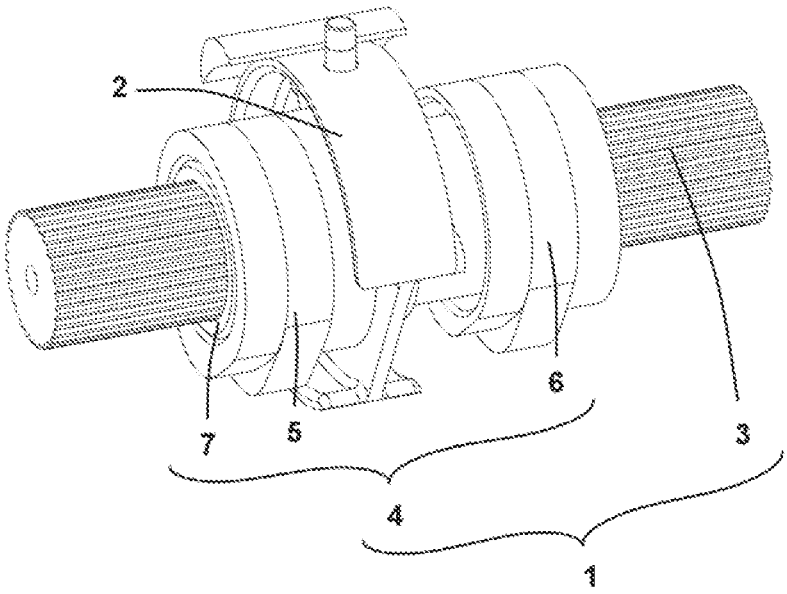
FIG. 1: shows a schematic illustration of a device for a valve train for switching the lift of gas exchange valves of an internal combustion engine.

In an embodiment, the invention provides a valve train device for switching the lift of gas exchange valves of an internal combustion engine, wherein the overall space required, the technical complexity and the mechanical stresses on the adjustment device are reduced.

An embodiment of the invention provides a device, with which the lift of gas exchange valves of a valve train of an internal combustion engine can be varied in a particularly advantageous manner. To this end, a camshaft of the valve train is formed of a carrier shaft and a cam assembly. The cam assembly is non-rotatably, yet axially displaceably connected to the carrier shaft. At least one group of axially directly adjacent cams having an identical base circle, but different cam protrusions is arranged on the cam assembly. A cam without a cam protrusion can also advantageously be provided in this cam group to implement a valve shut-off. This cam group is associated with a gas exchange valve. The gas exchange valve associated with the cam group is in contact at least with one of the different cams of the cam group. The cam in contact with the gas exchange valve is changed by axially displacing the cam assembly with respect to the gas exchange valve. The lift is thus switched as a result of the different cam protrusions or, for example, the lift is stopped by a zero-lift cam. For internal combustion engines having a plurality of gas exchange valves for each cylinder, a cam group can be associated with each gas exchange valve. A cam group is advantageously associated with at least one inlet valve. In internal combustion engines having a plurality of inlet valves for each cylinder, the cam groups of the respective inlet valve can be combined to form a common cam assembly, wherein it is possible for the lift of the respectively assigned gas exchange valve to be switched synchronously between the different cams having different cam protrusions. The cams of the respectively associated cam groups, which are simultaneously in contact with the gas exchange valves, may have identical cam contours or cam protrusions for symmetrical valve lift, or may have different cam contours or cam protrusions so as to produce an asymmetrical valve lift.

A bearing region, in which the cam assembly and therefore also the carrier shaft are supported radially, is provided between the cam groups of the respective gas exchange valve pair. The cam assembly is advantageously supported radially with respect to a camshaft bearing by an additional, co-axially positioned bearing bush, which is axially displaceable with respect to the camshaft bearing and with respect to the cam assembly. Furthermore, the bearing bush is positioned non-rotatably in the camshaft bearing of the cylinder head so that rotatable movement between the bearing bush and the camshaft bearing is not possible. When the camshaft is rotated, a rotatable movement is only implemented between the bearing region of the cam assembly and the bearing bush. According to an embodiment of the invention, a contour having an axially extending profile in the form of an individual sawtooth in the direction of the bearing bush arranged between the two cam groups is provided on the cam groups opposing the bearing region. A reverse contour in the form of an individual sawtooth opposing the contour of the respective cam group is provided on either side of the bearing bush. The contour in the form of a sawtooth is defined by the fact that an axial deflection starting from a minimum to a maximum increases continuously within the length of the periphery. The length of the periphery is given by a complete revolution of the camshaft: afterwards, the original minimum again follows with the next revolution and increases continuously again until reaching the maximum. The axial extent of the contour over a number of revolutions equates to a sawtooth course. As an alternative embodiment of the contours, contour courses which produce an axial deflection, at least in a portion of a periphery, are also possible. Within the scope of the invention, a reverse contour is understood to mean a contour which can be brought into operative contact with an opposing contour, wherein the opposing contours run against one another and produce an axial lift.

According to an embodiment of the invention, the necessary radial height of the contours is advantageously reduced by the approximately planar frictional contact between the contours and the associated low stress, and the axial overall length of the device for switching lift can be reduced by suitable crossovers and overlaps of contour, cam groups and bearing bushes. The respective opposing contours of a cam group and the bearing bush mounted between the cam groups can be brought into frictional contact by displacing the bearing bush from a neutral position into a switching position. A radially deployed dowel is provided for displacement of the bearing bush into a switching position and is guided outwardly via a recess in the camshaft bearing. The bearing bush is displaced axially by an actuation apparatus, which is connected to the dowel. For a first switching position, the bearing bush is displaced in such a way that the first opposing axial contour of the bearing bush comes into frictional contact with the axial contour of the first cam group. For a second switching position, the bearing bush is displaced in such a way that the second axial contour of the bearing bush comes into frictional contact with the opposing axial contour of the second cam group. The opposing axial contours run against one another due to the rotating carrier shaft and the entrained cam assembly and the rotatably fixed bearing bush, and therefore the peaks of the respective contours together produce the necessary axial lift for switching from one cam to the next cam of the cam groups on the cam assembly. Switching between a number of cams is carried out sequentially. Switching in a first direction of the cam groups is achieved by actuation of the first switching position. The second switching position must be set in order to switch in a second direction. Upon each switching operation, the axial lift necessary to switch between a first cam and the adjacent second cam is produced. To switch to a third cam, which is adjacent to the second cam, the corresponding switching position has to be set again, since the bearing bush is located in the neutral position after each switching operation. The axial displacement of the bearing bush accordingly precedes the axial displacement of the cam assembly. The axial position of the cam assembly on the carrier shaft is ensured by suitable locking devices, the axial retaining force of which can be overcome by the retaining force of an actuation apparatus. Due to an engagement by means of the locking devices, the axial displacement is assisted by the engagement process, and therefore a final portion of the displacement path from one cam to the next cam can only be overcome by the engagement. The necessary axial lift applied by the reverse contours, and therefore at least one maximum of one contour for switching, can therefore be slightly smaller than the centre-to-centre distance between the cams. The peaks of the axial contours on the cam groups and on the bearing bush can therefore rotate past one another, in the engaged state, without contact within the neutral position of the bearing bush.

The moment at which the switch occurs is defined by the angular position of the axial course of the axial contour on the cam group of the respective gas exchange valves with respect to the camshaft. Switching is carried out between the cams when the peaks of the reverse contours coincide and the necessary axial lift is thus produced. For example, a camshaft for internal combustion engines having a plurality of cylinders can be composed of a carrier shaft and a plurality of axially offset, identical cam assemblies rotated relative to one another. The number of cylinders of the internal combustion engine determines the angular offset, and the spacing between the cylinders determines the axial offset of the cam assemblies from one another. Since identical cam assemblies can be used for each cylinder, the relative phase offset of the contours is given from the rotation of the cam assemblies. In conventional internal combustion engines, the angular range for a camshaft revolution is thus divided by the position of the peaks of the individual cam assemblies into equal angular ranges corresponding to the number of cylinders. If identical bearing bushes are advantageously also used for the adjustment device, the bearing bushes must therefore also be rotated according to the rotation of the cam assemblies of the respective cylinder, and therefore the moment of switching is defined by the mutual superposition of the peaks of the contours. To this end, only the axial guide for non-rotatable installation of the bearing bush in the camshaft bearing have to be changed according to the rotation of the cam assemblies of the respective cylinder. All bearing bushes can be displaced simultaneously into the corresponding switching position in a particularly simple manner via a central actuation apparatus, since the moment of switching for the cam group or for the cam assembly of the respective cylinder is determined by the course of the contour. Alternatively, the corresponding moment of switching between the cams of the cam groups can also be determined by adapting the angular reference of the contour course over the cam groups or over the bearing bushes so that the correct switching moment is ensured according to the necessary angular offset from cylinder to cylinder.

Embodiment of a Device for Switching Lift

Figure 2:
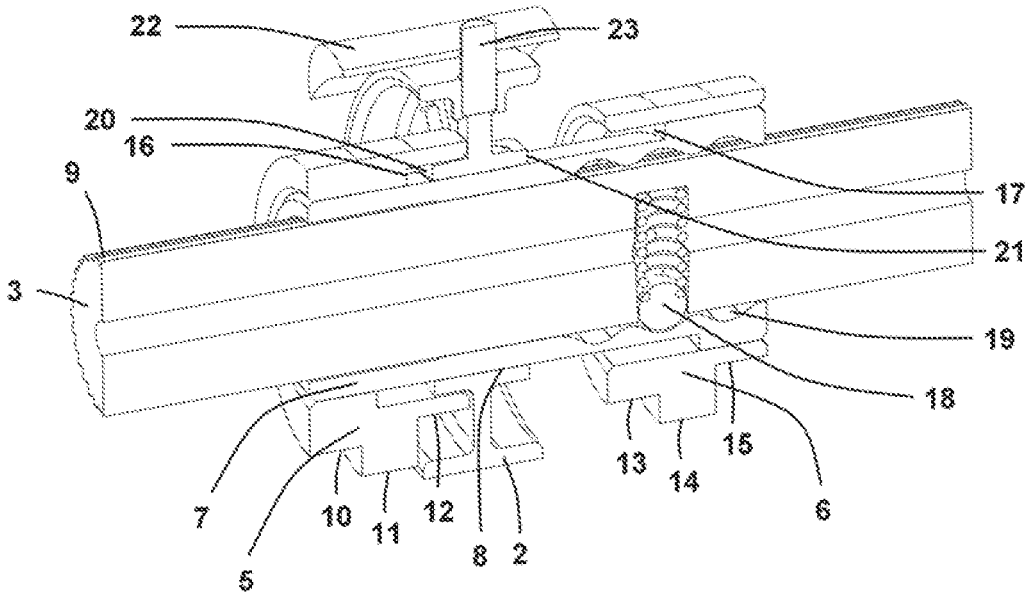
FIG. 2: shows a schematic sectional illustration of a device for a valve train for switching the lift of gas exchange valves of an internal combustion engine.

The device according to an embodiment of the invention, illustrated in FIG. 1, comprises a camshaft 1 and a bearing bush 2. The camshaft 1 is in turn formed by a carrier shaft 3 and a cam assembly 4 mounted thereon. The cam assembly 4 comprises a first cam group 5 and a second cam group 6, which are rigidly connected to a cam group carrier 7. A bearing region 8 is provided between the mutually spaced cam groups 5, 6, as illustrated in FIG. 2. The cam assembly 4 is mounted non-rotatably, yet displaceably on the carrier shaft 3 via an axial guide 9. Each of the two cam groups 5, 6 is formed by three axially directly adjacent cams 10, 11, 12, 13, 14, 15, wherein the cams 10, 11, 12, 13, 14, 15 at least have different cam protrusions. Furthermore, an axial contour 16, 17, which is oriented axially in the direction of the opposing cam group 5, 6, is provided on each cam group 5, 6. A first axial contour 16 is arranged in the region of the first cam group 5, and a second axial contour 17 is arranged in the region of the second cam group 6. The axial contours 16, 17 can be formed either directly on the respective cam group 5, 6 or on the cam carrier 7 in the region of the cam groups 5, 6. The cam assembly 4 is held in the corresponding axial position relative to the gas exchange valves to be actuated via an engagement element which is formed as a ball detent 18 and consists of a spring-loaded ball mounted in the carrier shaft 3, wherein the ball engages in recesses 19 in the cam group carrier 7. As many recesses 19 are provided in the cam group carrier 7 as there are different cams 10, 11, 12, 13, 14, 15 in a cam group 5, 6 so as to allow axial locking in each position. The bearing bush 2 is mounted axially displaceably and rotatably on the bearing region 8 so as to support the camshaft 1 radially with respect to a camshaft bearing. A first reverse axial contour 20 is arranged on the bearing bush 2 to correspond to the opposing first cam group 5, and a second reverse axial contour 21 is arranged on the other side of the bearing bush 2 to correspond to the opposing second cam group 6. The axial contours 16, 17, 20, 21 are formed as a saw-toothed profile with axial deflection. Run-on regions for reducing the accelerations and the stress can be provided within the course of the contour. The bearing bush 2 is mounted non-rotatably, yet axially displaceably with respect to the camshaft bearing by means of a bearing bush guide 22. A dowel 23, which is incorporated rigidly in the bearing bush 2 and is connected to an actuation apparatus via a recess through the camshaft bearing, is provided for displacing the bearing bush 2 into the respective switching position.

Embodiment of a Method for Switching Lift

Figure 3:
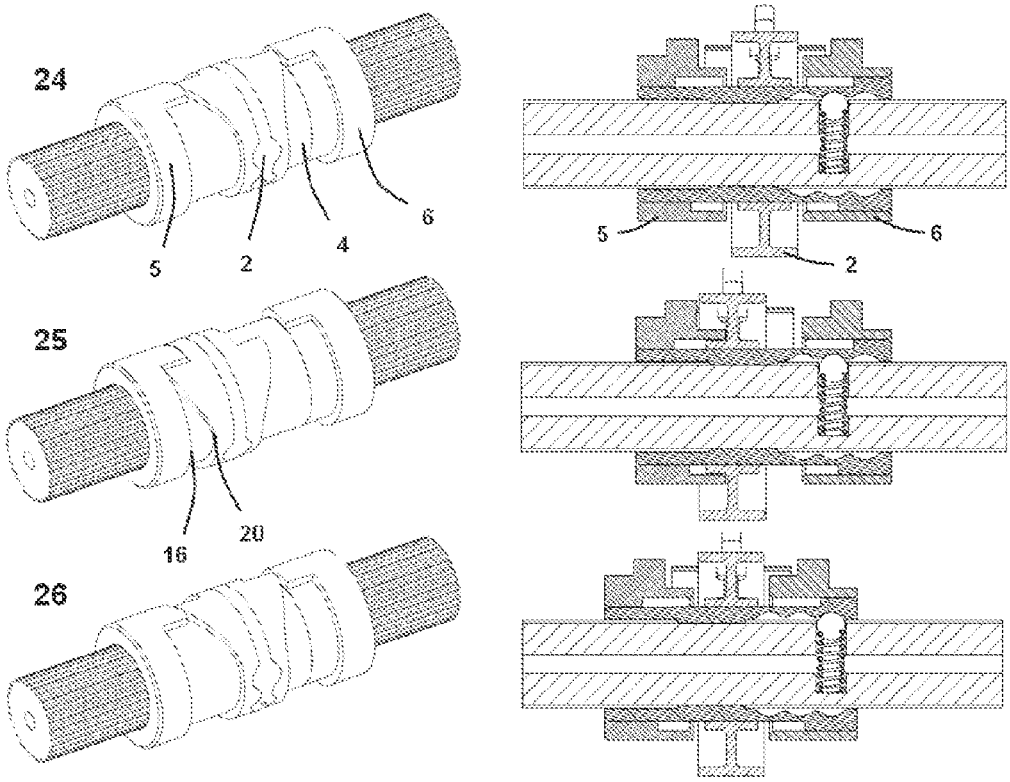
FIG. 3: shows a schematic illustration for carrying out a switching operation.

Different positions 24, 25, 26 during a switching operation are illustrated in FIG. 3. For a switching operation, the bearing bush 2 is displaced, starting from a neutral position 24, into a first switching position 25 to initiate the switching operation. The first axial contour 16 of the first cam group 5 thus comes into frictional contact with the first opposing axial contour 20 on the bearing bush 2, said axial contours running against one another due to the rotation of the carrier shaft 3 and therefore of the cam assembly 4. According to the sawtooth-like axial deflection, the spacing between the bearing bush 2 fixed in the first switching position 25 and the first cam group 5 is increased and the cam assembly 4 is displaced into the lockable next position 26. The retaining force of the bearing bush 2, which is applied by the actuation apparatus, has to be greater than the retaining force which is produced by the ball detent 18. In the next position 26 of the cam assembly 4, the bail detent 18 locks in the next recess 19 in the cam carrier 7. Due to the engagement by means of the ball detent 18 and the recesses 19 in the cam carrier 7, the axial displacement is assisted by the engagement process, since the spring-loaded ball presses into the recess 19. The last portion of the displacement path from one cam 10, 11, 12, 13, 14, 15 to the next cam 10, 11, 12, 13, 14, 15 is overcome merely by the engagement process, which is assisted by the bail detent 18. It is thus ensured that the axial lift applied by the reverse contours 16, 17, 20, 21 and required for switching can be slightly smaller than the centre-to-centre distance between the cams 10, 11, 12, 13, 14, 15, and therefore the peaks of the axial contours 16, 17, 20, 21 on the cam groups 5, 6 and on the bearing bush 2 can rotate past one another, in the engaged state, without contact.

LIST OF REFERENCE NUMERALS

1 camshaft
2 bearing bush
3 carrier shaft
4 cam assembly
5 first cam group
6 second cam group
7 cam group carrier
8 bearing region
9 axial guide
10, 11, 12, 13, 14, 15 cams
16 first axial contour
17 second axial contour
18 ball detent
19 recess
20 first opposing axial contour
21 second opposing axial contour
22 bearing bush guide
23 dowel

What is claimed is:

1. A valve train device for switching lift of gas exchange valves of an internal combustion engine, the valve train device comprising:

at least one camshaft including a carrier shaft and at least one cam assembly disposed non-rotatably and axially displaceably on the carrier shaft via a guide, the at least one cam assembly including a bearing region, at least one cam group having at least two cams and a first and a second axial contour; and a bearing bush mounted non-rotatably and axially displaceably in a camshaft bearing and radially supporting the at least one camshaft in the camshaft bearing, the at least one cam assembly being mounted rotatably and axially displaceably in the bearing bush in the bearing region, the bearing bush including a first axial reverse opposing contour that corresponds to, and is switchable into operative contact with, the first axial contour and a second axial reverse opposing contour that corresponds to, and is switchable into operative contact with, the second axial contour.

2. The device according to claim 1, wherein at least one of the first and the second axial contour is movable into the operative contact with a respective one of the first and the second axial reverse opposing contours.

3. The device according to claim 1, wherein at least one the axial contours and the axial reverse opposing contours provide a sawtooth-like course in axial deflection.

4. The device according to claim 1, wherein the axial contours include run-on regions having a lesser axial gradient than an average axial gradient.

5. The device according to claim 1, wherein the first and second axial reverse opposing contours each correspond to a reverse of the respective first and second axial contours.

6. The device according to claim 1, further comprising a dowel disposed on the bearing bush and configured to displace the bearing bush in the camshaft bearing.

7. The device according to claim 1, wherein at least one of the axial contours spatially coincides with at least one cam group so as to reduce the overall axial length of the device.

8. A method for switching lift of gas exchange valves of an internal combustion engine, the method comprising:

providing at least one camshaft and a bearing bush radially supporting the at least one camshaft in a camshaft bearing, the at least one camshaft including a carrier shaft and at least one cam assembly disposed non-rotatably and axially displaceably on the carrier shaft via a guide, the at least one cam assembly including a bearing region and at least one cam group having at least two cams; and initiating a switching operation by displacing the bearing bush from a neutral position into a switching position so as to bring an axial contour of the at least one cam assembly and a reverse contour of the bearing bush into frictional contact with each other.

9. The method according to claim 8, further comprising producing an axial lift of the cam assembly via the frictional contact between the contours so as to switch to a next cam.

* * * * *